US008519890B2

(12) United States Patent
Huang et al.

(10) Patent No.: US 8,519,890 B2
(45) Date of Patent: Aug. 27, 2013

(54) PLANAR BI-DIRECTIONAL RADIATION ANTENNA

(75) Inventors: Huan-Chu Huang, Taoyuan County (TW); Chien-Ting Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 286 days.

(21) Appl. No.: 13/008,020

(22) Filed: Jan. 18, 2011

(65) Prior Publication Data

US 2011/0234467 A1 Sep. 29, 2011

(30) Foreign Application Priority Data

Mar. 25, 2010 (TW) ..... 99108927 A

(51) Int. Cl.
*H01Q 1/38* (2006.01)
*H01Q 19/10* (2006.01)

(52) U.S. Cl.
USPC ..... 343/700 MS; 343/846; 343/837; 343/836; 343/829; 343/793

(58) Field of Classification Search
None
See application file for complete search history.

(56) References Cited

U.S. PATENT DOCUMENTS 4,291,312 A 9/1981 Kaloi
6,198,437 B1 3/2001 Watson et al.
6,567,055 B1 5/2003 Oglesby
7,132,985 B2 * 11/2006 Lin ..... 343/700 MS
7,324,059 B2 * 1/2008 Lee et al. ..... 343/795
7,557,755 B2 * 7/2009 Han et al. ..... 343/700 MS
8,049,672 B2 * 11/2011 Chang et al. ..... 343/767
2004/0100407 A1 * 5/2004 Okado ..... 343/700 MS
2005/0156788 A1 7/2005 Lin

FOREIGN PATENT DOCUMENTS

EP 0688040 12/1995
EP 1814195 8/2007
JP 7202562 8/1995

OTHER PUBLICATIONS

"Search Report of Europe Counterpart Application", issued on Mar. 8, 2011, pp. 1-7.
"First Office Action of China counterpart application" issued on Apr. 22, 2013, pp. 1-8.

* cited by examiner

*Primary Examiner* — Trinh Dinh
(74) *Attorney, Agent, or Firm* — Jianq Chyun IP Office

(57) ABSTRACT

A planar bi-directional radiation antenna including a substrate, a first reflecting element, an antenna body, a second reflecting element and a third reflecting element is provided. The first reflecting element is concaved inwards to form a first notch in a first surface. The antenna body is located inside the first notch, and is symmetrical to a predetermined direction with the first reflecting element. The second reflecting element is concaved inwards to form a second notch in a second surface. The configuration of the first notch and the second notch is correspondingly disposed along a vertical projection plane with respect to the substrate. The third reflecting element is opposite to the antenna body along the predetermined direction, and covers an opening of the first notch, so that the antenna generates two beams, wherein the two beams have an angle relative to the substrate, so as to achieve a bi-directional radiation effect.

13 Claims, 7 Drawing Sheets

PLANAR BI-DIRECTIONAL RADIATION ANTENNA

CROSS-REFERENCE TO RELATED APPLICATION

This application claims the priority benefit of Taiwan application serial No. 99108927, filed on Mar. 25, 2010. The entirety of the above-mentioned patent application is hereby incorporated by reference herein and made a part of this specification.

BACKGROUND

1. Field of the Invention

The subject application relates to an antenna. More particularly, the subject application relates to a planar bi-directional radiation antenna.

2. Description of Related Art

Antenna is an indispensable device for many wireless communication systems, which is a main element related to a whole performance of the system. Generally, the antennas can be grouped into isotropic antennas, omni-directional antennas and directive antennas according to directivities thereof. Wherein, the directive antenna can transceive electromagnetic energy of a specific direction, so that it can be widely used in fixed direction-based wireless communication systems.

The antenna having a bi-directional radiation function is mainly used to implement communication of three fixed locations, so that directivity thereof is highly required. A general bi-directional radiation antenna or device generally applies two antenna units (i.e. radiators), for example, two patch antennas or slot antennas to implement the bi-directional radiation. However, according to such conventional method, not only complexity, cost and size of the antenna are increased, but also implementation of a symmetric bi-directional radiation effect cannot be achieved (for example, due to a disposing position of a feeding structure), or a high directivity cannot be achieved (for example, due to inadequate system grounding area of the patch antenna). Therefore, the subject application provides a single planar antenna design to achieve effects such as simple fabrication, low cost, small size, symmetric bi-directional radiation and high directivity.

Moreover, by using an antenna array formed by the bi-directional radiation antennas of the subject application, in a full-space scanning, a required radiation pattern can be synthesized according to electronic signal modulation, so as to avoid using mechanical devices required by a conventional rotating antenna array, and achieve a real-time scanning without time lag.

SUMMARY

The invention is directed to a planar bi-directional radiation antenna, which has a bi-directional radiation pattern, and can simplify a hardware structure of an electronic system.

The invention provides a planar bi-directional radiation antenna including a substrate, a first reflecting element, an antenna body, a second reflecting element and a third reflecting element. The substrate includes a first surface and a second surface. The first reflecting element is disposed on the first surface of the substrate, and an upper edge of the first reflecting element is concaved inwards to form a first notch in the first surface. The antenna body is disposed on the substrate, and is located inside the first notch, wherein the antenna body and the first reflecting element are respectively symmetrical to a predetermined direction. The second reflecting element is disposed on the second surface of the substrate, and an upper edge of the second reflecting element is concaved inwards to form a second notch in the second surface, wherein the first notch and the second notch have a corresponding configuration on a vertical projection plane. The third reflecting element is disposed on the substrate and is opposite to the antenna body along the predetermined direction, wherein the third reflecting element covers an opening of the first notch on the vertical projection plane, so that the planar bi-directional radiation antenna generates two beams, wherein the two beams have a first angle relative to the substrate, so as to achieve a bi-directional radiation effect.

In an exemplary embodiment of the present invention, the antenna body includes a first driving element and a second driving element. The first driving element is disposed on the first surface of the substrate, and has a first arm and a second arm. The second driving element is disposed on the second surface of the substrate, and has a first arm and a second arm. Wherein, the second driving element is extended out from the second reflecting element, the first arms of the first driving element and the second driving element are mutually overlapped on the vertical projection plane, and the second arms of the first driving element and the second driving element are symmetrical to the predetermined direction.

In an exemplary embodiment of the present invention, the first reflecting element includes a first extension portion and a second extension portion. The first extension portion is disposed on the first surface of the substrate, and is arranged at a side of the first arm of the first driving element. The second extension portion is disposed on the first surface of the substrate, and is arranged at another side of the first arm of the first driving element. Moreover, end portions of the first extension portion and the second extension portion correspond to a bottom edge of the second notch on the vertical projection plane.

According to the above descriptions, in the invention, the first reflecting element and the second reflecting element are used to reflect back the electromagnetic energy radiated towards the bottom of the notch by the antenna body to the opening of the notch, and the third reflecting element is used to again reflect back the electromagnetic energy reflected to the opening of the notch. In this way, since the electromagnetic energy radiated by the antenna body leaks out along a direction perpendicular to the substrate, the planar bi-directional radiation antenna simultaneously generates two radiation beams radiating towards the top and the bottom of the substrate. Therefore, the bi-directional radiation pattern of the planar bi-directional radiation antenna avails simplifying the hardware structure of the electronic system, and avails miniaturization of the electronic system.

In order to make the aforementioned and other features and advantages of the subject application comprehensible, several exemplary embodiments accompanied with figures are described in detail below.

BRIEF DESCRIPTION OF THE DRAWINGS

The accompanying drawings are included to provide a further understanding of the subject application, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
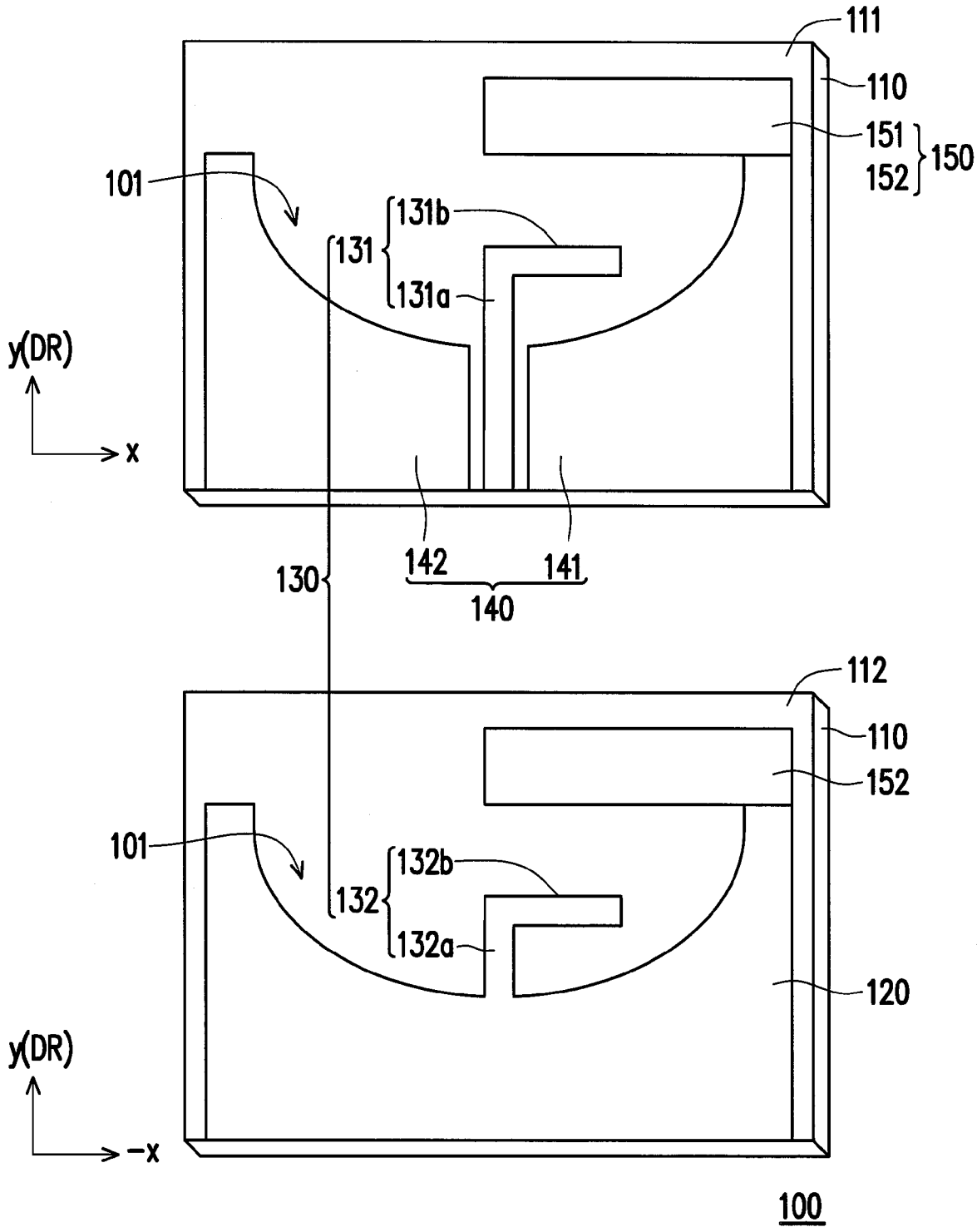
FIG. 1 is a structural layout diagram illustrating a planar bi-directional radiation antenna according to an exemplary embodiment of the invention.
Figure 2:
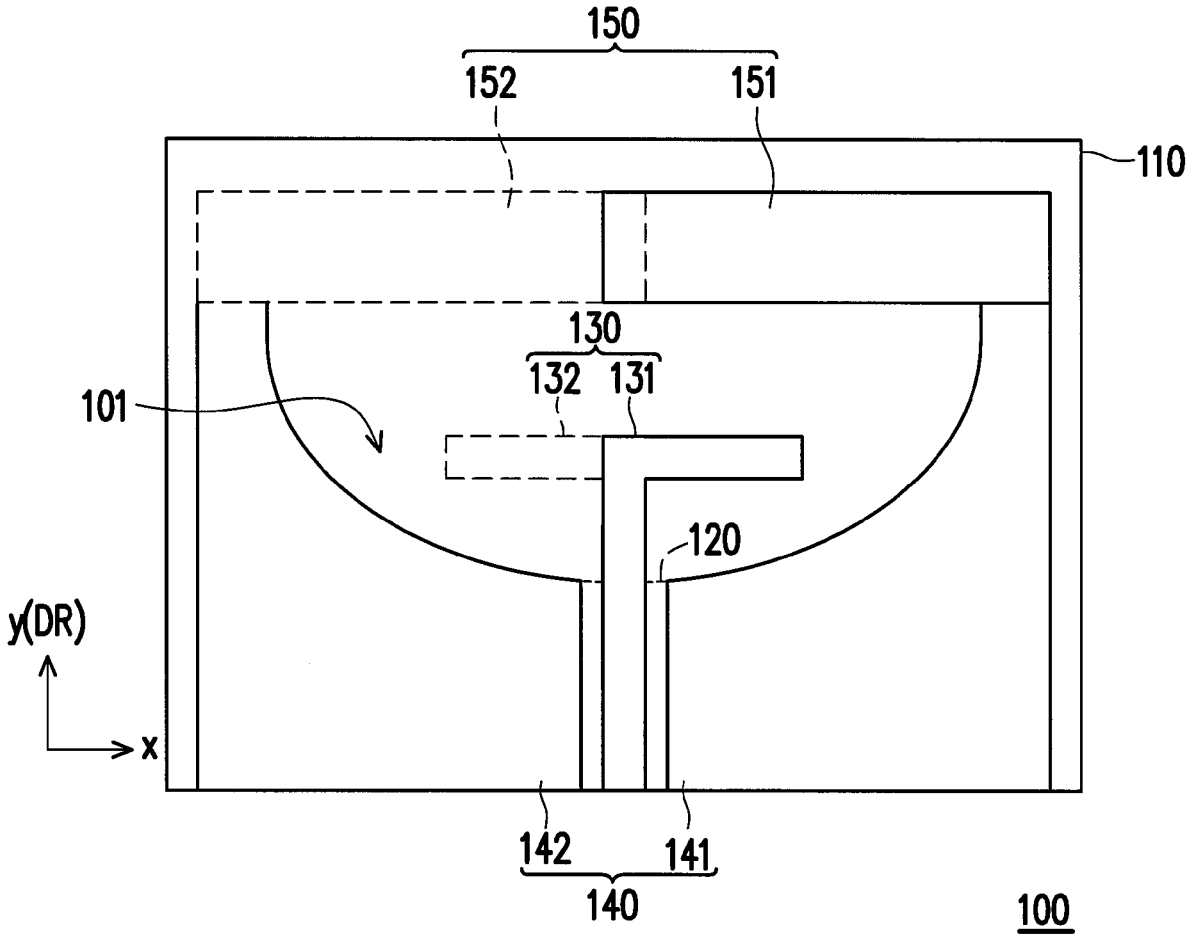
FIG. 2 is a perspective view of a planar bi-directional radiation antenna according to an exemplary embodiment of the invention.

FIG. 1 is a structural layout diagram illustrating a planar bi-directional radiation antenna according to an exemplary embodiment of the invention. FIG. 2 is a perspective view of a planar bi-directional radiation antenna according to an exemplary embodiment of the invention. Referring to FIG. 1 and FIG. 2, the planar bi-directional radiation antenna 100 includes a substrate 110, a first reflecting element 140, an antenna body 130, a second reflecting element 120 and a third reflecting element 150. The substrate 110 includes a first surface 111 and a second surface 112. The first reflecting element 140 is disposed on the first surface 111 of the substrate 110, and the second reflecting element 120 is disposed on the second surface 112 of the substrate 110. Moreover, relative to the antenna body 130, the first reflecting element 140 and the second reflecting element 120 all have an arc-shaped design concaved inwards to respectively form a notch 101 in the first surface 111 and the second surface 112.

The antenna body 130 includes a first driving element 131 and a second driving element 132. Wherein, the first driving element 131 is disposed on the first surface 111 of the substrate 110, and the second driving element 132 is disposed on the second surface 112 of the substrate 110. In a practical implementation, the antenna body 130 is, for example, a dipole antenna, so that the first driving element 131 and the second driving element 132 respectively have an L-shape, and respectively have two arms. For example, the first driving element 131 has a first arm 131*a* and a second arm 131*b*, and the second driving element 132 has a first arm 132*a* and a second arm 132*b*.

Regarding an overall structure of the antenna body 130, the second driving element 132 is extended out from the second reflecting element 120, so that the second reflecting element 120 is equivalent to a grounding plane (which can also be equivalent to a system grounding plane) of the antenna body 130. Moreover, the first arm 131*a* of the first driving element 131 and the first arm 132*a* of the second driving element 132 are mutually overlapped on a vertical projection plane, and the second arm 131*b* of the first driving element 131 and the second arm 132*b* of the second driving element 132 are symmetrical to a predetermined direction DR.

The first reflecting element 140 includes a first extension portion 141 and a second extension portion 142. The first extension portion 141 and the second extension portion 142 are all disposed on the first surface 111 of the substrate 110. Moreover, the first extension portion 141 is arranged at a side of the first arm 131*a* of the first driving element 131, and the second extension portion 142 is arranged at another side of the first arm 131*a* of the first driving element 131. It should be noticed that the first extension portion 141 and the second extension portion 142 respectively have an end portion located near a bottom edge of the notch 101 of the first surface 111, the two end portions correspond to the bottom edge of the notch 101 of the second surface 112 on the vertical projection plane, and a position relationship between the two end portions and the bottom edges of the notch 101 on the vertical projection plane can be mutually parallel, totally overlapped or partially overlapped. To be more specific, there are three mutually corresponding configurations in an practical application: (1) on the vertical projection plane, the bottom edge of the notch 101 on the first surface 111 is totally aligned and overlapped to the bottom edge of the notch 101 on the second surface 112; (2) on the vertical projection plane, the bottom edge of the notch 101 on the first surface 111 protrudes out the bottom edge of the notch 101 on the second surface 112; (3) on the vertical projection plane, the bottom edge of the notch 101 on the first surface 111 is recessed in the bottom edge of the notch 101 on the second surface 112. For example, in the present exemplary embodiment, as shown in the perspective view of FIG. 2, the two end portions (i.e. the bottom edge of the notch 101 on the first surface 111) of the first extension portion 141 and the second extension portion 142 are totally overlapped to the bottom edge of the notch 101 on the second surface 112 on the vertical projection plane, so that the first extension portion 141 and the second extension portion 142 all have a concaved arc-shape.

The third reflecting element 150 includes a first coverage portion 151 and a second coverage portion 152. Wherein, the first coverage portion 151 is disposed on the first surface 111 of the substrate 110, and is opposite to the second arm 131*b* of the first driving element 131. The second coverage portion 152 is disposed on the second surface 112 of the substrate 110, and is opposite to the second arm 132*b* of the second driving element 132. Moreover, the first coverage portion 151 is electrically connected to the first extension portion 141 of the first reflecting element 140, and the second coverage portion 152 is electrically connected to the second reflecting element 120.

Regarding an overall structure of the planar bi-directional radiation antenna 100, as shown in FIG. 2, the antenna body 130 and the first reflecting element 140 are respectively symmetrical to a predetermined direction DR, and the antenna body 130 is disposed in the notch 101. Moreover, in the present exemplary embodiment, the bottom edge of the notch 101 comprises a parabolic shape, and the antenna body 130 is located around a focus of the parabolic curve. Moreover, the first reflecting element 140 surrounds the bottom edge of the notch 101 on the vertical projection plane, and the third reflecting element 150 covers an opening of the notch 101 on the vertical projection plane. In this way, the first reflecting element 140, the second reflecting element 120 and the third reflecting element 150 surround the whole antenna body 130 on the vertical projection plane.

Figure 3A:
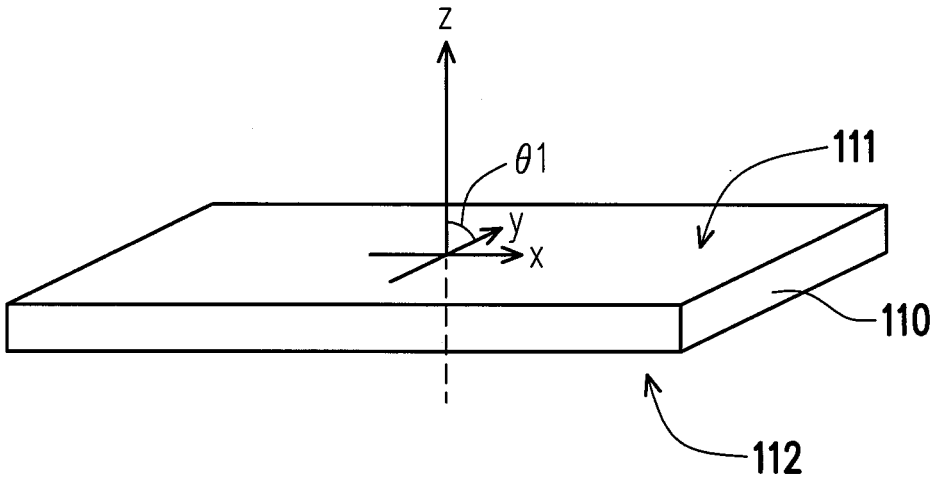
FIG. 3A is a three-dimensional view of a substrate according an exemplary embodiment of the invention.

In this way, the electromagnetic energy radiated towards the bottom of the notch 101 by the antenna body 130 would be immediately reflected back by the first reflecting element 140 and the second reflecting element 120, then the electromagnetic energy radiated towards the bottom of the notch 101 would be leading to the opening of the notch 101. However, since the opening of the notch 101 is covered by the third reflecting element 150, the electromagnetic energy leaded to the opening of the notch 101 is blocked and is again reflected back. In this way, the antenna body 130 cannot radiate the major electromagnetic energy towards any direction parallel to the substrate 110, so that as shown in a three-dimensional view of the substrate 110 of FIG. 3A, the electromagnetic energy of the antenna body 130 leaks out along a direction (i.e. a +z axis and a −z axis) perpendicular to the substrate 110, and therefore the planar bi-directional radiation antenna 100 simultaneously generates two beams radiating towards the top (for example, the +z axis) and the bottom (for example, the −z axis) of the substrate 110. In the present exemplary embodiment, since the bottom edge of the notch 101 on the first surface 111 is totally aligned and overlapped to the bottom edge of the notch 101 on the second surface 112 (shown as FIG. 2 and FIG. 3A), ideally, an angle formed between the two beams and an x-y plane is 90 degrees. Further, by adjusting a relative position (for example, the aforementioned protrusion and recession relative positions) of the bottom edge of the notch 101 on the first surface 111 and the bottom edge of the notch 101 on the second surface 112, the angle formed between the two beams and the x-y plane can be changed, and possible applications thereof are described in detail below.

It should be noticed that since the planar bi-directional radiation antenna 100 comprises a bi-directional radiation pattern, practical implementation of the planar bi-directional radiation antenna 100 can reduce an area and a size of an electronic system, for example, a vehicular anti-collision system, a microwave relay station, a smart antenna system and a radar system, etc.

For example, at least two antennas have to be set up in a general microwave relay station, wherein one of the antennas is used for receiving radio signals from a previous relay station, and another one of the antennas is used for transmitting the radio signals to a next relay station. However, when the planar bi-directional radiation antenna 100 of the subject application is applied to the microwave relay station, since the planar bi-directional radiation antenna 100 can generate the bi-directional radiation patterns, the conventional receiving characteristic can be implemented by setting up only one such type of the antenna in the microwave relay station, so as to effectively simplify the hardware structure of the microwave relay station.

Figure 3B:
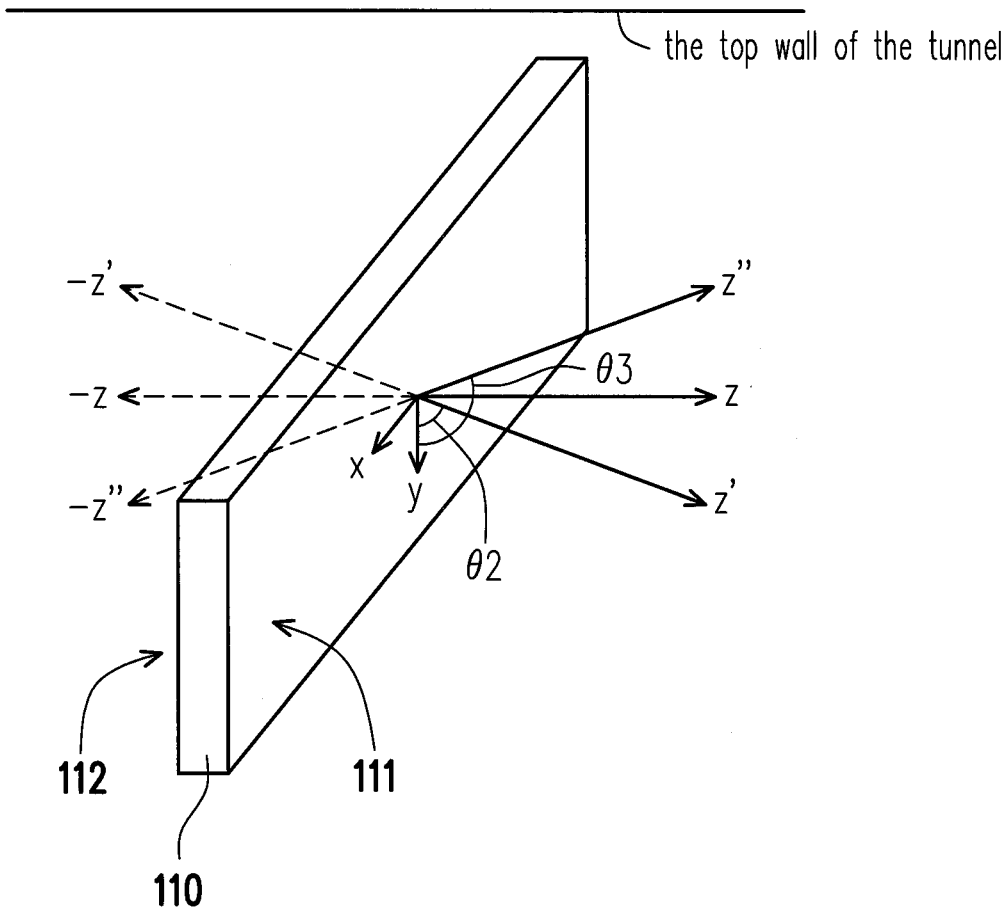
FIG. 3B is a three-dimensional view of a substrate in a tunnel according an exemplary embodiment of the invention.

Moreover, in a tunnel space implementation, since global positioning system (GPS) signals or other radio signals are uneasy to be received in a tunnel, the planar bi-directional radiation antenna 100 of the subject application can be disposed at a suitable place in the tunnel, so that the GPS signals transmitted through a GPS signal relay station or an amplifier station out of the tunnel can be directly transmitted towards two tunnel portals according to the radiation directions (+z and −z directions) of the signals radiated by the planar bi-directional radiation antenna 100 of the subject application, so as to achieve a tunnel booster function, wherein +z and −z directions are also regarded as the driving directions of the vehicles in the tunnel. In this way, the vehicle entering the tunnel from any portal can receive the GPS signals. In other words, the planar bi-directional radiation antenna 100 of the present exemplary embodiment avails simplifying a hardware structure of the GPS signal relay or the amplifier station. In the present exemplary embodiment, the bottom edge of the notch 101 on the first surface 111 is totally aligned and overlapped to the bottom edge of the notch 101 on the second surface 112. Ideally, the angle $\theta_1$ between the radiation directions (+z and −z) of the two beams and the x-y plane is 90 degrees (as that shown in FIG. 3A). Further, referring to FIG. 3B, by adjusting the relative position of the bottom edge of the notch 101 on the first surface 111 and the bottom edge of the notch 101 on the second surface 112, the radiation direction (+z or −z) of the original beams can be changed, and an angle between such beam and the x-y plane is $\theta_2$ or $\theta_3$, wherein $\theta_2$ is less than $\theta_1$, and $\theta_3$ is greater than $\theta_1$. In the example of FIG. 3B, on the vertical projection plane, if the bottom edge of the notch 101 on the first surface 111 is protruded out the bottom edge of the notch 101 on the second surface 112, the radiation path (+z') of such beam can be more close to the vehicles moving in the tunnel, so that the reception of the GPS signals can be improved. Certainly, according to the above adjusting method, those skilled in the art can adjust the bottom edge of the notch 101 on the first surface 111 to recess in the bottom edge of the notch 101 on the second surface 112, so as to generate a radiation beam (−z") symmetric to the +y direction with the +z' radiation beam, which can be determined according to an actual application requirement.

Certainly, according to the above adjusting method, those skilled in the art can also suitably change an arrangement of the third reflecting element, wherein the third reflecting element may include the first coverage portion 151, the second coverage portion 152, a third coverage portion 410 and a fourth coverage portion 420, which can also change a radiation direction of any of the beams, wherein an angle between such beam and the x-y plane would be range from $\theta_2$ to $\theta_3$. If the relative position of the notches and the relative position of these coverage portions are suitably changed simultaneously, the bi-directional radiation effect is achieved. Referring to the above alternative arrangement of the notch positions for implementation of this example, and detailed descriptions thereof are not repeated.

Moreover, in implementation of a vehicular anti-collision system, the planar bi-directional radiation antenna 100 can simultaneously detect distances between the moving vehicle and the rear and front vehicles, so that a hardware structure of the vehicular anti-collision system can be effectively simplified. Moreover, in implementation of an antenna array, for example, a radar system, since the planar bi-directional radiation antenna 100 can simultaneously scan towards both positive and negative directions, by using an electronic beam former, the radar system can achieve a full-space and real-time scanning without mechanical devices for rotating antenna array, so as to simplify a hardware structure of the radar system. Further, in view of military defence, it is better for the radar system being concealed and uneasy to be discovered. Namely, a deploy location of the radar system may be rather low relative to a ground plane, or may be shielded by external environment, so that traditionally a detecting effect of the radar signal is influenced. However, if the above manner of changing the beam radiation direction is applied to the radar system, an accuracy of the radar system can be effectively improved based on different radiation angles. Similarly, in case of the smart antenna system, a quantity of antenna units can be reduced based on the bi-directional scanning characteristic of the planar bi-directional radiation antenna 100, which avails miniaturization and low-cost of the smart antenna system.

It should be noticed that the planar bi-directional radiation antenna 100 mainly uses the third reflecting element 150 to reflect back the electromagnetic energy radiated towards the opening of the notch 101. Wherein, the first coverage portion 151 of the third reflecting element 150 is mainly used to reflect the electromagnetic energy radiated towards the opening of the notch 101 by the first driving element 131, and the second coverage portion 152 is mainly used to reflect the electromagnetic energy radiated towards the opening of the notch 101 by the second driving element 132. Therefore, in an practical implementation, lengths of the first coverage portion 151 and the second coverage portion 152 are respectively greater than the second arm 131*b* of the first driving element 131 and the second arm 132*b* of the second driving element 132.

Figure 4:
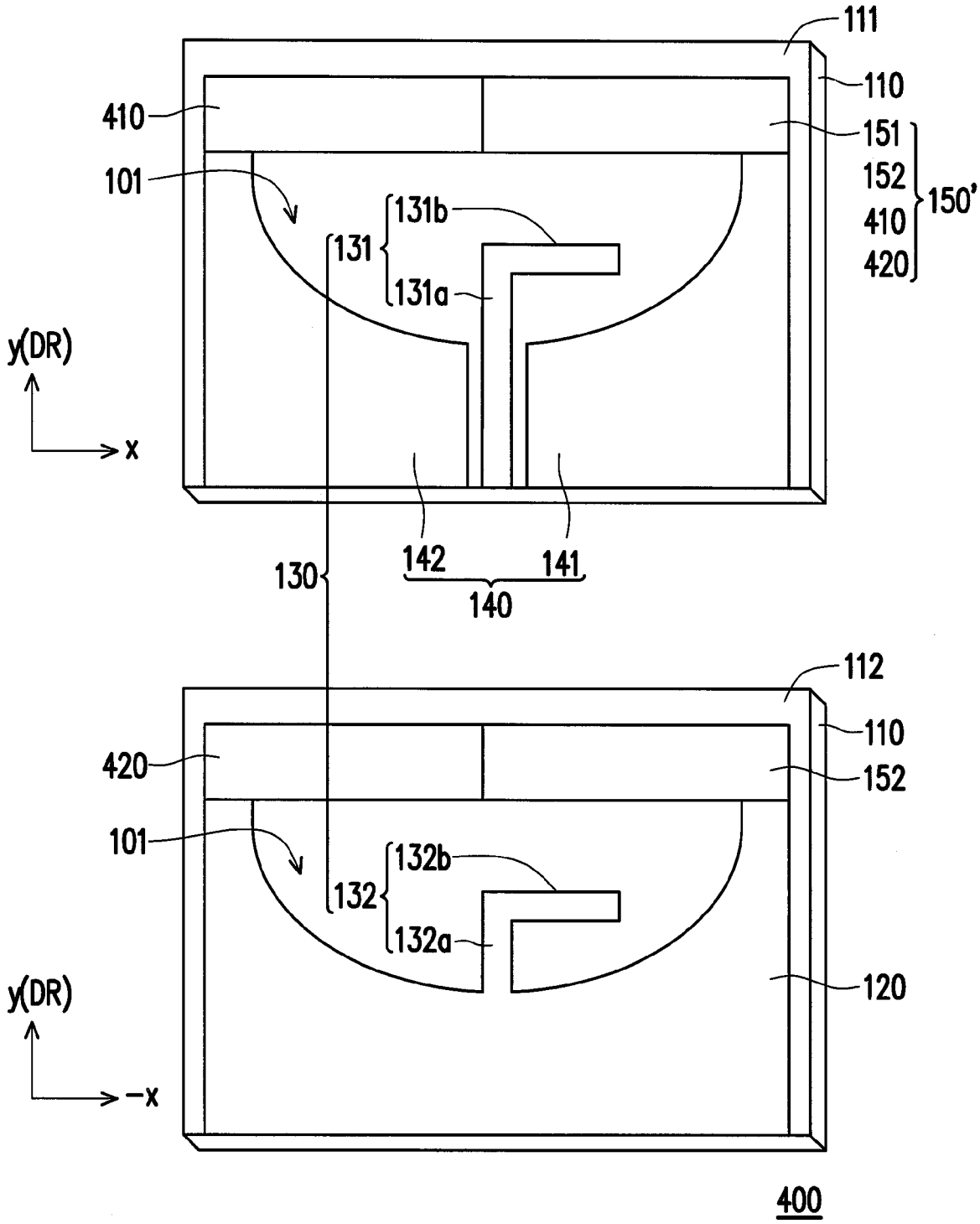
FIG. 4 is a structural layout diagram illustrating a planar bi-directional radiation antenna according to another exemplary embodiment of the invention.

Moreover, in the practical implementation, additional coverage portions can be set to strengthen a blocking capability of the third reflecting element 150 for the electromagnetic energy. For example, FIG. 4 is a structural layout diagram illustrating a planar bi-directional radiation antenna according to another exemplary embodiment of the invention. Compared to the exemplary embodiment of FIG. 1 and FIG. 2, the third reflecting element 150' of the exemplary embodiment of FIG. 4 further includes a third coverage portion 410 and a fourth coverage portion 420. As shown in FIG. 4, the third coverage portion 410 is disposed on the first surface 111 of the substrate 110, and is overlapped to the second coverage portion 152 on the vertical projection plane. Moreover, the fourth coverage portion 420 is disposed on the second surface 112 of the substrate 110, and is overlapped to the first coverage portion 151 on the vertical projection plane.

Therefore, the first driving element 131 disposed on the first surface 111 is surrounded by the first coverage portion 151, the third coverage portion 410 and the first reflecting element 140, and the second driving element 132 disposed on the second surface 112 is surrounded by the second coverage portion 152, the fourth coverage portion 420 and the second reflecting element 120. In this way, the first reflecting element 140, the second reflecting element 120 and the third reflecting element 150 can further increase a directivity of the planar bi-directional radiation antenna 400 along a direction perpendicular to the substrate 110. It should be noticed that in the practical implementation, the blocking capability for the electromagnetic energy can be strengthened by simultaneously setting the third coverage portion 410 and the fourth coverage portion 420, or setting one of the third coverage portion 410 and the fourth coverage portion 420, so that those skilled in the art can arbitrarily change the configuration of the third reflecting element 150' according to an actual design requirement.

Figure 5:
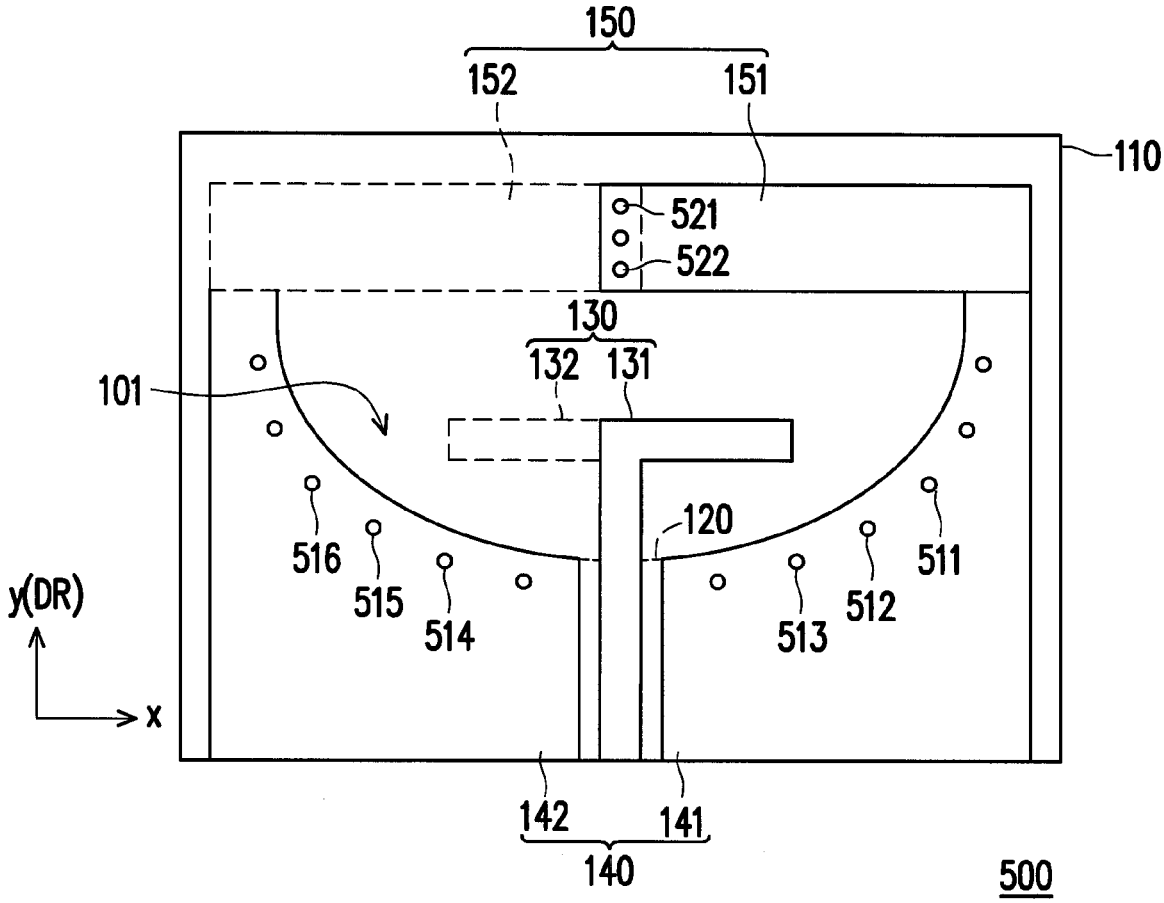
FIG. 5 is a perspective view of a planar bi-directional radiation antenna according to still another exemplary embodiment of the invention.

Moreover, in the planar bi-directional radiation antenna 100, a plurality of vias can be set to enhance a characteristic of the reflecting element through a metal characteristic of the vias. For example, FIG. 5 is a perspective view of a planar bi-directional radiation antenna according to still another exemplary embodiment of the invention. Compared to the exemplary embodiment of FIG. 1 and FIG. 2, the planar bi-directional radiation antenna 500 of the exemplary embodiment of FIG. 5 further includes a plurality of first vias 511-516, and a plurality of second vias 521-522. Wherein, the first vias 511-513 penetrate through the second reflecting element 120, the substrate 110 and the first extension portion 141, and the first vias 514-516 penetrate through the second reflecting element 120, the substrate 110 and the second extension portion 142. In this way, the first reflecting element 140 can be electrically connected to the second reflecting element 120 through the first vias 511-516. Moreover, the second vias 521-522 penetrate through the first coverage portion 151, the substrate 110 and the second coverage portion 152, so that the first coverage portion 151 is electrically connected to the second coverage portion 152. In this way, as the characteristic of the reflecting element is enhanced, directivity of the planar bi-directional radiation antenna 500 along a direction perpendicular to the substrate 110 can be enhanced. Moreover, while the vias are used to enhance the characteristic of the reflecting element, as shown in FIG. 4, additional coverage portions can be set to strengthen the blocking capability of the third reflecting element 150' for the electromagnetic energy.

Figure 6:
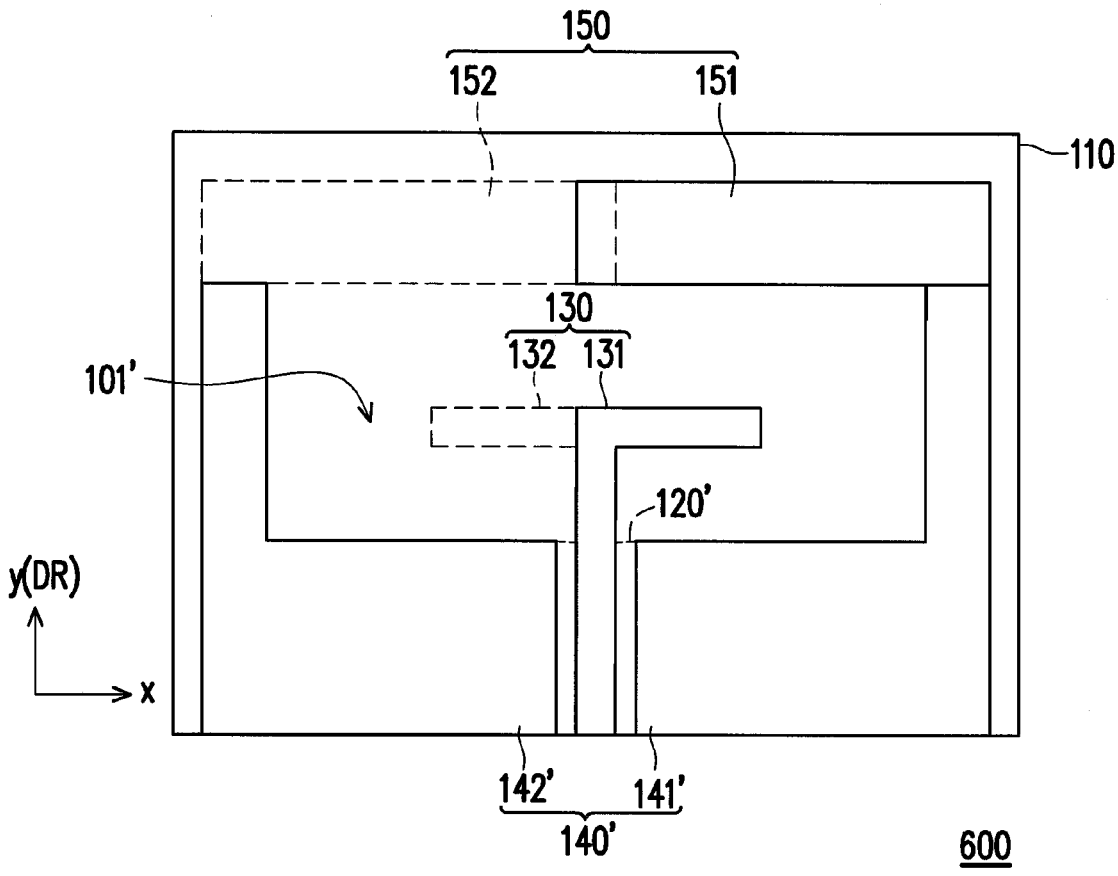
FIG. 6 is a perspective view of a planar bi-directional radiation antenna according to yet another exemplary embodiment of the invention.

Furthermore, in the above exemplary embodiments, the bottom edge of the notch 101 comprises a parabolic shape, though in an practical implementation, the shape of the bottom edge of the notch 101 is not limited thereto, which can also be an arc-shape, a wavy-shape, or a polygonal shape. For example, FIG. 6 is a perspective view of a planar bi-directional radiation antenna according to yet another exemplary embodiment of the invention. Compared to the exemplary embodiment of FIG. 1 and FIG. 2, a main difference between the exemplary embodiment of FIG. 6 and that of FIG. 1 and FIG. 2 lies in a shape of a bottom edge of a notch 101' formed in a first reflecting element 140', and a shape of a bottom edge of a notch 101' formed in a second reflecting element 120' of the planar bi-directional radiation antenna 600. As shown in FIG. 6, by adaptively adjusting concave radians of the first reflecting element 140' and the second reflecting element 120', the bottom edge of the notch 101' may also have a polygonal shape.

Figure 7:
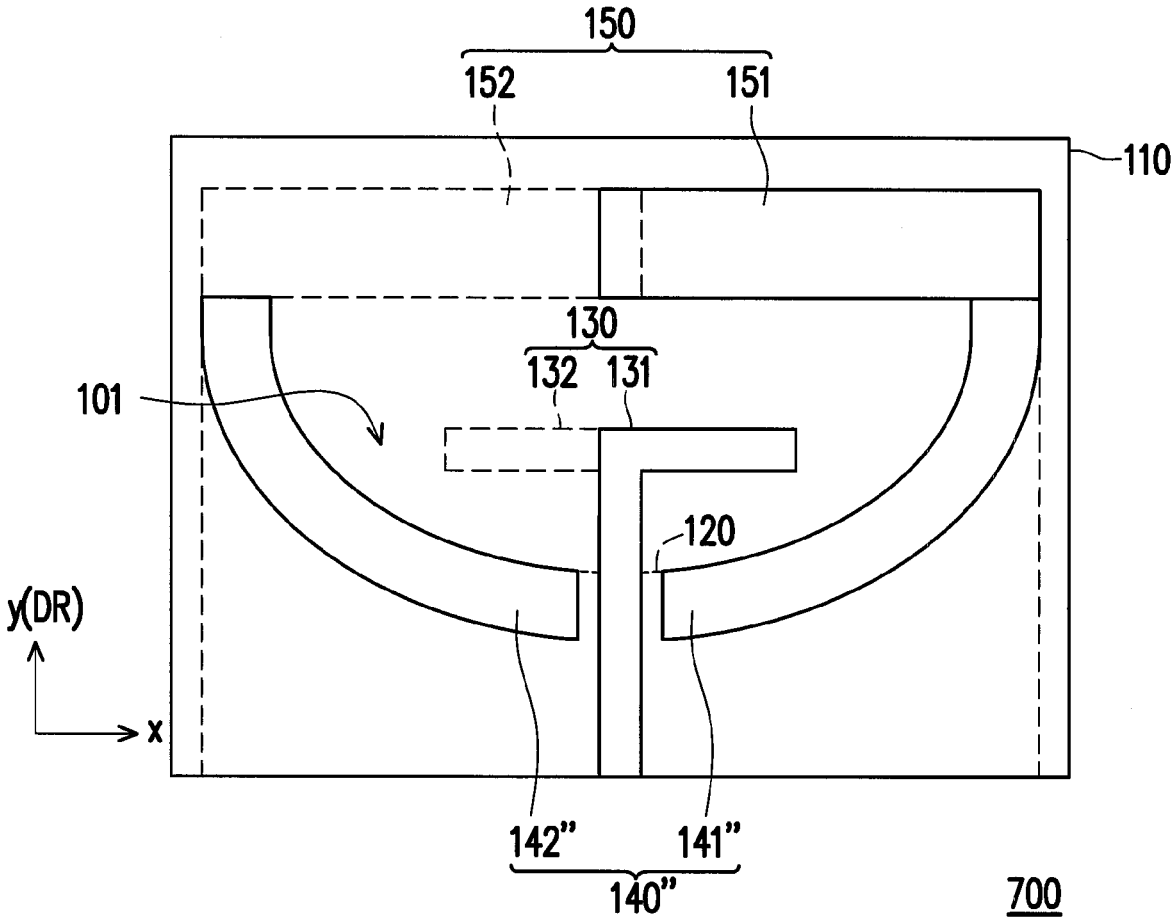
FIG. 7 is a perspective view of a planar bi-directional radiation antenna according to yet another exemplary embodiment of the invention.

On the other hand, in the above exemplary embodiments, deployments of the first reflecting elements 140 all have a planar layout, though a designer can adjust layout areas thereof according to an actual design requirement. For example, FIG. 7 is a perspective view of a planar bi-directional radiation antenna according to yet another exemplary embodiment of the invention. Compared to the exemplary embodiment of FIG. 1 and FIG. 2, a main difference between the exemplary embodiment of FIG. 7 and that of FIG. 1 and FIG. 2 lies in layout areas and shapes of a first reflecting element 140". As shown in FIG. 7, the first reflecting element 140" can be regarded as planar metal strips other than original metal planes. In this way, a layout area of the planar bi-directional radiation antenna 700 on the first surface 111 of the substrate 110 can be correspondingly reduced, which avails miniaturization of the planar bi-directional radiation antenna 700.

In summary, in the subject application, since the first reflecting element, the second reflecting element and the third reflecting element are disposed to surround the antenna body on the vertical projection plane, the electromagnetic energy of the antenna leaks out along a direction perpendicular to the substrate rather than a direction parallel to the substrate. In this way, the planar bi-directional radiation antenna can simultaneously generate two beams radiating towards the top and the bottom of the substrate, so as to achieve the characteristic of bi-directional radiation. Comparatively, in a practical implementation, the bi-directional radiation patterns of the planar bi-directional radiation antenna avails simplifying the hardware structure of the electronic system, and avails miniaturization of the electronic system.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar bi-directional radiation antenna, comprising:

a substrate, comprising a first surface and a second surface;

a first reflecting element, disposed on the first surface of the substrate, and a first notch in the first surface being formed by a concavely recessed upper edge of the first reflecting element;

an antenna body, disposed on the substrate, and located inside the first notch, wherein the antenna body and the first reflecting element are respectively symmetrical to a predetermined direction; a second reflecting element, disposed on the second surface of the substrate, and a second notch in the second surface being formed by a concavely recessed upper edge of the second reflecting element, wherein the first and second reflecting elements overlap with each other at least partially in a projection onto a plane in parallel with the substrate the first notch and the second notch have a corresponding configuration on a vertical projection plane;

a third reflecting element, disposed on the substrate, wherein the antenna body and the third reflecting element are arranged sequentially along the predetermined direction, wherein the third reflecting element covers openings of the first and second notches at least partially, and the first reflecting element, the second reflecting element and the third reflecting element entirely surround the antenna body to thereby form the planar bi-directional radiation antenna generating two beams, wherein the two beams have a first angle relative to the substrate.

2. The planar bi-directional radiation antenna as claimed in claim 1, wherein the third reflecting element is electrically connected to the first reflecting element and the second reflecting element.

3. The planar bi-directional radiation antenna as claimed in claim 1, wherein a bottom edge of the first notch forms an arc-shape, a parabolic shape or a polygonal shape.

4. The planar bi-directional radiation antenna as claimed in claim 1, wherein the antenna body comprises:

a first driving element, disposed on the first surface of the substrate, and having a first arm and a second arm; and a second driving element, disposed on the second surface of the substrate, having a first arm and a second arm, and extended out from the second reflecting element, wherein the first arm of the first driving element and the first arm of the second driving element are mutually overlapped in the projection onto the plane in parallel with the substrate, and the second arm of the first driving element and the second arm of the second driving element are symmetrical to the predetermined direction in the projection onto the plane in parallel with the substrate.

5. The planar bi-directional radiation antenna as claimed in claim 4, wherein the first reflecting element comprises:

a first extension portion, disposed on the first surface of the substrate, and arranged at a side of the first arm of the first driving element; and a second extension portion, disposed on the first surface of the substrate, and arranged at another side of the first arm of the first driving element, wherein end portions of the first extension portion and the second extension portion overlap with a bottom edge of the second notch in the projection onto the plane in parallel with the substrate or are parallel with each other.

6. The planar bi-directional radiation antenna as claimed in claim 5, further comprising:

a plurality of first vias, penetrating through the second reflecting element, the substrate and the first extension portion or penetrating through the second reflecting element, the substrate and the second extension portion, so that the first reflecting element is electrically connected to the second reflecting element.

7. The planar bi-directional radiation antenna as claimed in claim 4, wherein the third reflecting element comprises:

a first coverage portion, disposed on the first surface of the substrate, and opposite to the second arm of the first driving element; and a second coverage portion, disposed on the second surface of the substrate, and opposite to the second arm of the second driving element, wherein the first coverage portion and the second coverage portion are electrically connected to the first reflecting element and the second reflecting element, respectively.

8. The planar bi-directional radiation antenna as claimed in claim 7, wherein the third reflecting element further comprises:

a third coverage portion, disposed on the first surface of the substrate, and at least partially overlapping with the second coverage portion in the projection onto the plane in parallel with the substrate.

9. The planar bi-directional radiation antenna as claimed in claim 7, wherein the third reflecting element further comprises:

a fourth coverage portion, disposed on the second surface of the substrate, and at least partially overlapping with the first coverage portion in the projection onto the plane in parallel with the substrate.

10. The planar bi-directional radiation antenna as claimed in claim 7, further comprising:

a plurality of second vias, penetrating through the first coverage portion, the substrate and the second coverage portion, so that the first coverage portion is electrically connected to the second coverage portion.

11. The planar bi-directional radiation antenna as claimed in claim 7, wherein lengths of the first coverage portion and the second coverage portion are respectively greater than the second arms of the first driving element and the second driving element.

12. The planar bi-directional radiation antenna as claimed in claim 1, wherein the upper edges of the first and second reflecting elements overlap with each other completely in the projection onto the plane in parallel with the substrate, so that the first angle is 90 degrees.

13. The planar bi-directional radiation antenna as claimed in claim 1, wherein the upper edges of the first and second reflecting elements overlap with each other partially in the projection onto the plane in parallel with the substrate, so that the first angle is less than 90 degrees or greater than 90 degrees.

* * * * *